US008016507B2

(12) United States Patent
Wright

(10) Patent No.: US 8,016,507 B2
(45) Date of Patent: Sep. 13, 2011

(54) DIRECTIONAL DISPENSING VALVE

(75) Inventor: Darcy J. Wright, Bay City, MI (US)

(73) Assignee: Liquid Molding Systems, Inc., Midland, MI (US)

( * ) Notice: Subject to any disclaimer, the term of this patent is extended or adjusted under 35 U.S.C. 154(b) by 890 days.

(21) Appl. No.: 12/012,961

(22) Filed: Feb. 6, 2008

(65) Prior Publication Data

US 2009/0196677 A1 Aug. 6, 2009

(51) Int. Cl.
*B05C 11/00* (2006.01)

(52) U.S. Cl. ..... 401/266

(58) Field of Classification Search ..... 401/261–266
See application file for complete search history.

(56) References Cited

U.S. PATENT DOCUMENTS

| | | | | |
|---|---|---|---|---|
| 421,362 | A * | 2/1890 | Underwood | 401/264 |
| 1,919,859 | A * | 7/1933 | Phillips | 401/264 |
| 2,316,516 | A * | 4/1943 | Hammerstein | 222/490 |
| D136,098 | S | 8/1943 | Hartman | |
| 2,611,515 | A | 9/1952 | Smith | |
| 2,684,789 | A | 7/1954 | Marchant | |
| 2,851,203 | A | 9/1958 | Nowak et al. | |
| 3,773,233 | A | 11/1973 | Souza | |
| 4,368,746 | A | 1/1983 | Spatz | |
| 4,419,393 | A | 12/1983 | Hanson | |
| 4,652,163 | A | 3/1987 | Karliner et al. | |
| 4,685,820 | A | 8/1987 | Kremer | |
| 4,693,623 | A | 9/1987 | Schwartzman | |
| 4,709,836 | A | 12/1987 | Andersen | |
| 5,033,655 | A | 7/1991 | Brown | |
| 5,172,996 | A | 12/1992 | Tamiya et al. | |
| 5,398,853 | A | 3/1995 | Latham | |
| 5,588,560 | A | 12/1996 | Benedict et al. | |
| 5,921,448 | A | 7/1999 | Stewart | |
| 6,402,413 | B1 | 6/2002 | Schwartzman | |
| 6,547,808 | B2 | 4/2003 | Tuckey et al. | |
| 6,688,501 | B2 | 2/2004 | De Groot et al. | |
| 6,932,532 | B2 | 8/2005 | Schwartzman | |
| 6,935,543 | B2 | 8/2005 | De Groot et al. | |
| 7,086,572 | B2 | 8/2006 | Socier et al. | |
| 7,226,230 | B2 | 6/2007 | Liberatore | |
| 7,306,128 | B2 | 12/2007 | Eimer | |
| 7,314,328 | B2 | 1/2008 | Liberatore | |
| 7,325,994 | B2 | 2/2008 | Liberatore | |
| 7,465,118 | B2 | 12/2008 | Liberatore | |
| 7,645,085 | B2 | 1/2010 | Liberatore | |

(Continued)

FOREIGN PATENT DOCUMENTS

| | | |
|---|---|---|
| CA | 976 113 | 10/1975 |

(Continued)

OTHER PUBLICATIONS

U.S. Appl. No. 10/811,180, filed Mar. 26, 2004.

(Continued)

*Primary Examiner* — Huyen Le
(74) *Attorney, Agent, or Firm* — Wood, Phillips, Katz, Clark & Mortimer

(57) ABSTRACT

A flexible, pressure-openable dispensing valve has a mounting base and has an outwardly extending head having at least three peripheral walls that each projects forwardly from the base. The head also includes an end wall that extends between, and connects, the outer margins of the peripheral walls. The end wall has a dispensing orifice surrounded by a spreading surface.

19 Claims, 11 Drawing Sheets

U.S. PATENT DOCUMENTS

| | | | |
|---|---|---|---|
| 2008/0205971 | A1 | 8/2008 | Liberatore |
| 2009/0045230 | A1 | 2/2009 | Liberatore |
| 2009/0218374 | A1 | 9/2009 | Liberatore |

FOREIGN PATENT DOCUMENTS

| | | | |
|---|---|---|---|
| EP | 0 178 377 | A2 | 4/1985 |
| FR | 2 790 454 | A1 | 9/2000 |
| JP | 43-16514 | | 7/1968 |
| JP | 37-999 | | 8/1984 |
| WO | WO 00/76873 | A1 | 12/2000 |
| WO | WO 2005/011875 | | 2/2005 |

OTHER PUBLICATIONS

U.S. Appl. No. 11/472,013, filed Jun. 21, 2006.

U.S. Appl. No. 11/471,814, filed Jun. 21, 2006.

Advertizing sheets (two sheets) of Aquila entitled "Bouchon & Tartiner ou à Etaler—Bec Verseur—" and "Bouchon à Tartiner ou àÉtaler—Nouveau Bec Vert Verseur—." Date: At least as early as Mar. 1999.

International Search Report and Written Opinion of the International Searching Authority, or the Declaration dated Mar. 9, 2009 for the international patent application PCT/US2009/00176 claiming priority of the above-captioned instant U.S. Appl. No. 12/012,961.

Office Action dated "Sep. 8, 2008" in co-pending U.S. Appl. No. 11/472,013 (which U.S. Patent Application was previously identified in the initial Information Disclosure Statement filed on Feb. 6, 2008 with the instant U.S. Appl. No. 12/012,961).

U.S. Appl. No. 10/628,097, filed Jul. 28, 2003, now abandoned.

U.S. Appl. No. 12/641,755, filed Dec. 18, 2009.

U.S. Appl. No. 11/536,851, filed Sep. 29, 2006.

* cited by examiner

FIG. 5
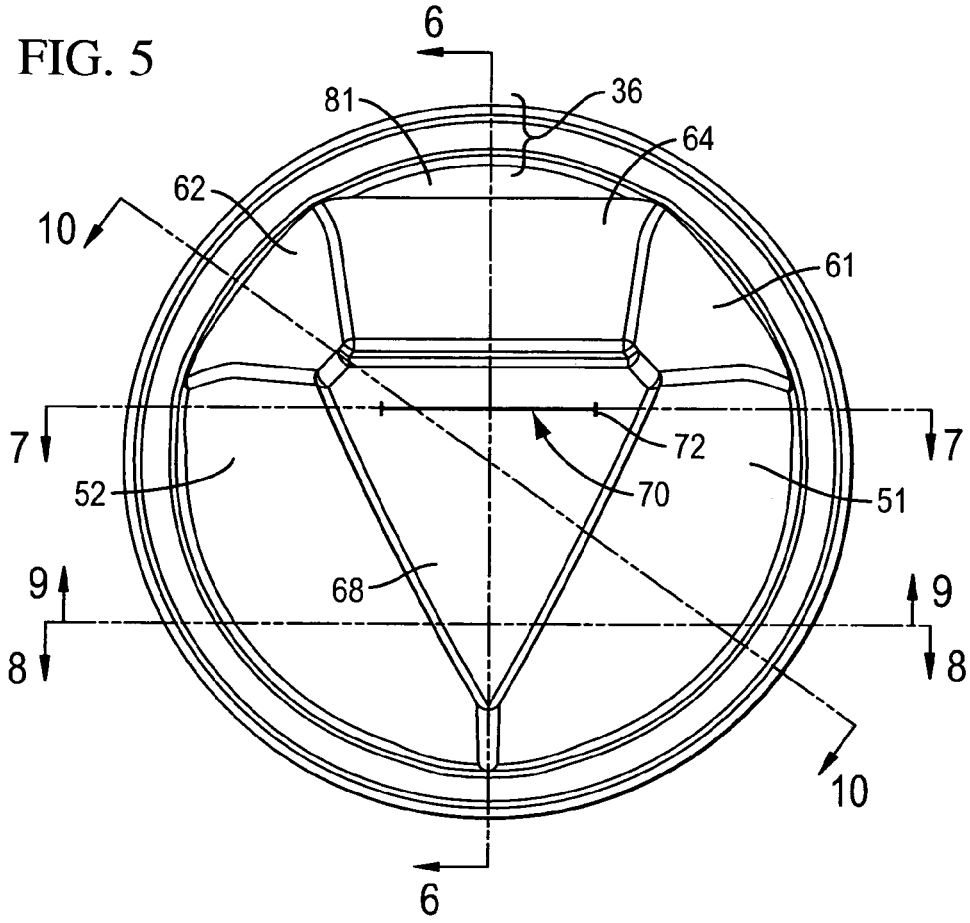
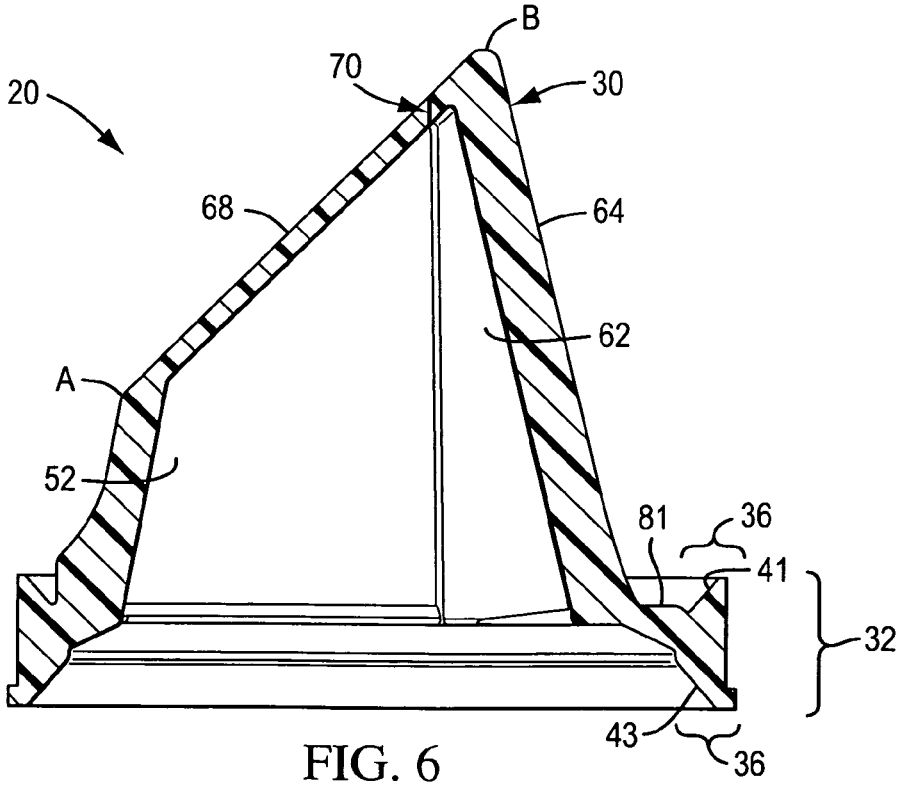
FIG. 6

DIRECTIONAL DISPENSING VALVE

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a valve for dispensing a product (e.g., a fluent material or other substance) from a container or other source of the product. The valve is particularly suitable for incorporation in a dispensing closure for use with a squeezable container.

BACKGROUND OF THE INVENTION AND TECHNICAL PROBLEMS POSED BY THE PRIOR ART

There are a wide variety of packages which include (1) a container, (2) a dispensing system extending as a unitary part of, or as an attachment to, the container, and (3) a fluent substance product contained within the container. One type of such a package employs one or more dispensing valves for discharging one or more streams of product (which may be a gas, liquid, cream, powder, or particulate product). See, for example, U.S. Pat. No. 5,271,531, U.S. Pat. No. 6,112,951, U.S. Pat. No. 6,230,940 and U.S. Pat. No. 7,086,575. Such valves are flexible and resilient, and have one or more self-sealing slits. Such valves can be mounted at one end of a bottle or container which typically has resiliently flexible side walls that can be squeezed to pressurize the container interior. The valve is normally closed and can withstand the weight of the product when the container is completely inverted, so that the product will not leak out unless the container is squeezed. When the container is squeezed and the interior is subjected to a sufficient increased pressure so that there is a predetermined minimum pressure differential across the valve, the valve opens. Such a valve can be designed so that it can also be opened merely by subjecting the exterior side of the valve to a sufficiently reduced pressure (e.g., as by sucking on the valve).

Such a type of valve can also be designed to stay open, at least until the pressure differential across the valve drops below a predetermined value. Such a valve can be designed to snap closed if the pressure differential across the open valve drops below a predetermined amount. The valve can also be designed to open inwardly to vent air into the container when the pressure within the container is less than the ambient external pressure, and this accommodates the return of the resilient container wall from an inwardly squeezed condition to the normal, unstressed condition.

Some other types of resilient, flexible, dispensing structures may instead have a small aperture that is always open at least a small amount (see, for example, the U.S. Pat. No. 6,547,808, column 4, lines 34-51 which describe a normally open orifice 24 with reference to FIG. 3 of the U.S. Pat. No. 6,547,808).

BRIEF SUMMARY OF THE INVENTION

The inventor of the present invention has discovered a new valve structure not taught or suggested by the prior art and which works especially well for dispensing substances such as, but not limited to, denture adhesive, toothpaste, cuticle cream, under eye cosmetic cream, etc. The inventor has found that the new valve aids the user in applying the substance to a surface as the substance is dispensed, and the valve can advantageously be used to dispense, wipe, spread, and smooth the dispensed substance as well as to scrape away excess amounts of the substance.

The valve has a configuration that also accommodates single handed dispensing without requiring excessive force to be applied by the user.

The valve shape makes it easy for the user to scrape excess product off of the valve exterior after the user has finished dispensing the desired amount of substance out of the valve.

The valve configuration also can facilitate the application of the dispensed substance in crevices and other narrow, or difficult to reach, regions, and the valve can flex in response to contours of the target region surface against which the substance is being dispensed.

The valve of the invention can be employed in a dispensing system that can accommodate bottles, containers, or packages which have a variety of shapes and which are constructed from a variety of materials.

Further, the valve can accommodate efficient, high-quality, manufacturing techniques with a reduced product reject rate to produce products having consistent operating characteristics unit-to-unit with high reliability.

BRIEF SUMMARY OF THE INVENTION

The present invention provides an improved dispensing valve for a fluent substance dispensing system. Such a system could include, for example, a container that has an opening to the container interior, and the valve could be mounted at the opening. The valve can be easily operated by the user to dispense a fluent substance in a desired direction to a target region.

The dispensing valve comprises (1) a mounting base, and (2) a flexible, resilient material defining a dispensing a head extending outwardly from the base. The dispensing head includes at least three peripheral walls that each projects outwardly from the base and that each defines an outer margin. The dispensing head also includes an end wall that (1) defines a dispensing orifice, (2) defines a spreading surface around the orifice, (3) extends between, and connects, the outer margins of the peripheral walls, and (4) is oriented to present the spreading surface extending from a first location to a second location that is further outwardly from the base than is the first location. In one preferred embodiment, the dispensing orifice is a normally closed dispensing orifice which opens to permit flow therethrough in response to a pressure differential across the valve.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 5 is a top, plan view of the valve;

FIG. 6 is a cross-sectional view taken generally along the plane 6-6 in FIG. 5;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, many of the figures illustrating the invention show a dispensing valve in a typical "upright" orientation that the valve may have when installed in a closure at the top of an upright container when the container is stored upright on its base, and terms such as upper, lower, horizontal, etc., are used with reference to this orientation. It will be understood, however, that the valve of this invention may be manufactured, stored, transported, used, and sold in an orientation other than the position described.

The valve of this invention is suitable for use with a variety of conventional or special dispensing systems, including containers having various designs, the details of which, although not illustrated or described, would be apparent to those having skill in the art and an understanding of such containers. The container and closure, per se, as referred to herein form no part of, and therefore are not intended to limit, the valve of the present invention. It will also be understood by those of ordinary skill that novel and non-obvious inventive aspects are embodied in the described valve alone.

Figure 1:
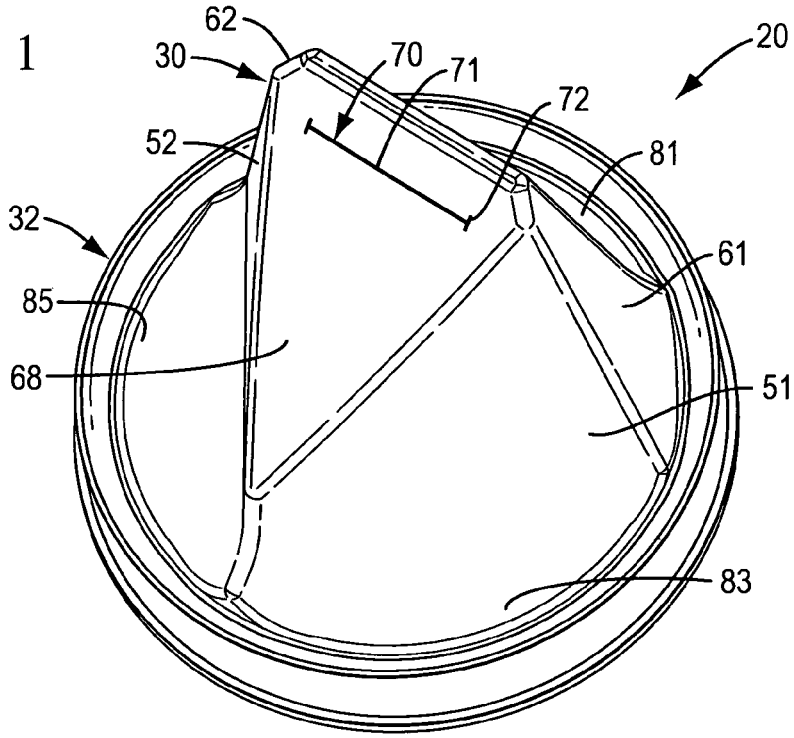
FIG. 1 is an isometric view of a first embodiment of the dispensing valve of the invention, and the dispensing valve is shown in FIG. 1 in a non-dispensing configuration, prior to installation on a container or other fluent substance handling system, and from a vantage point generally above, or from the top of, the valve.
Figure 2:
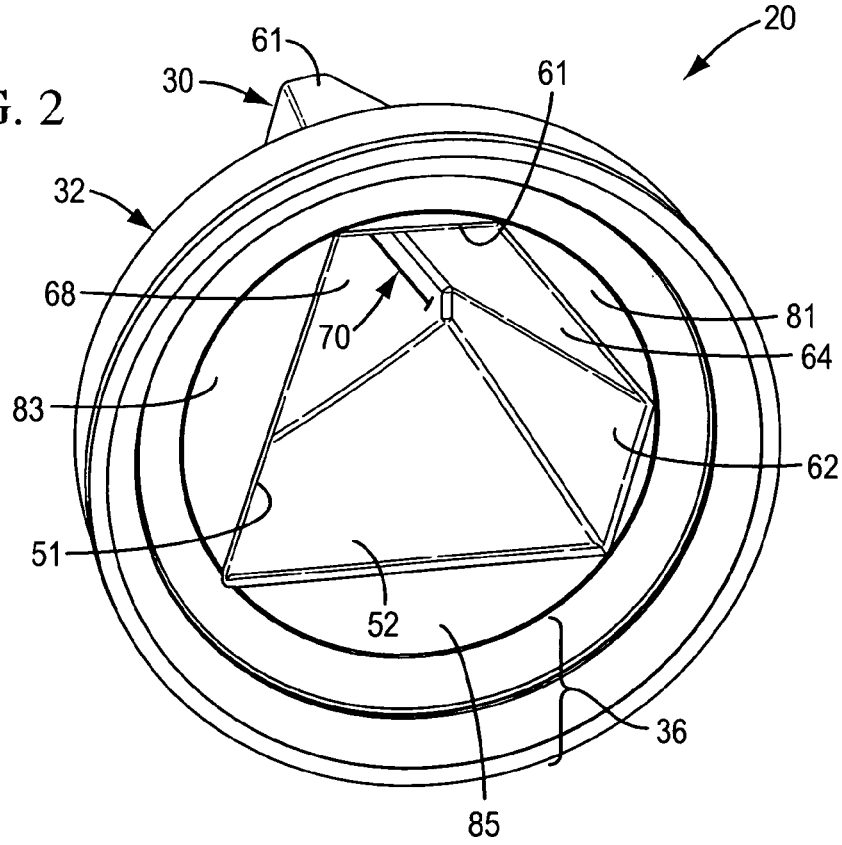
FIG. 2 is an isometric view of the underside of the valve shown in FIG. 1 looking up into the interior of the valve.
Figure 3:
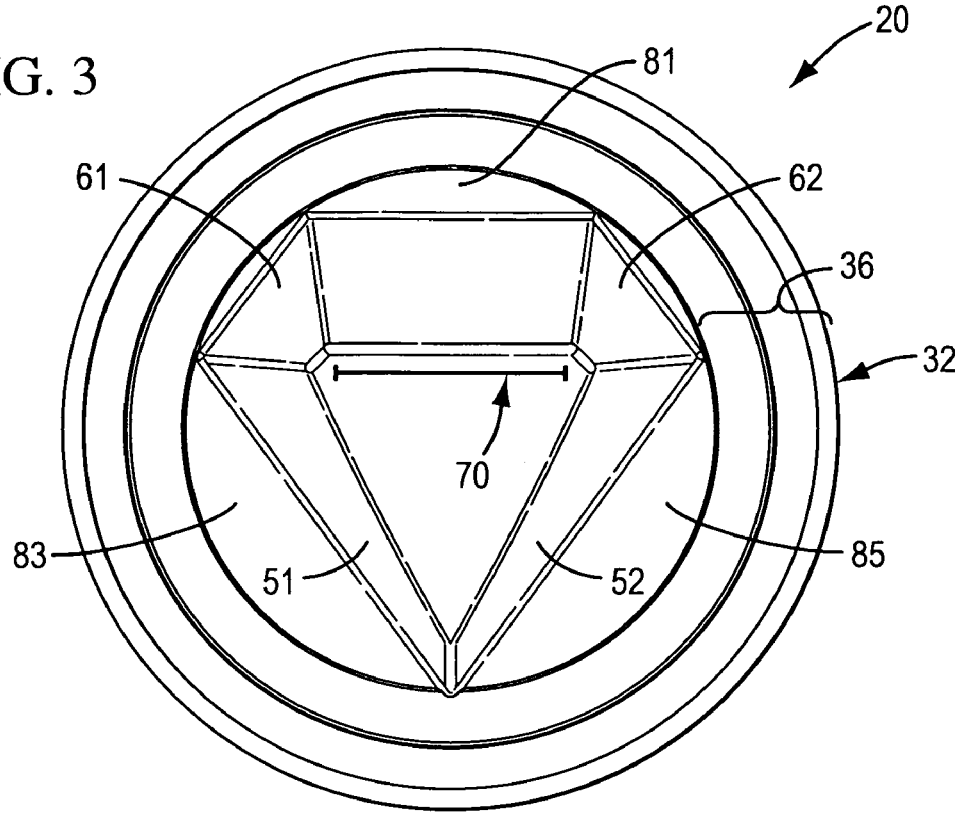
FIG. 3 is a bottom view of the valve looking up into the interior of the valve.
Figure 4:
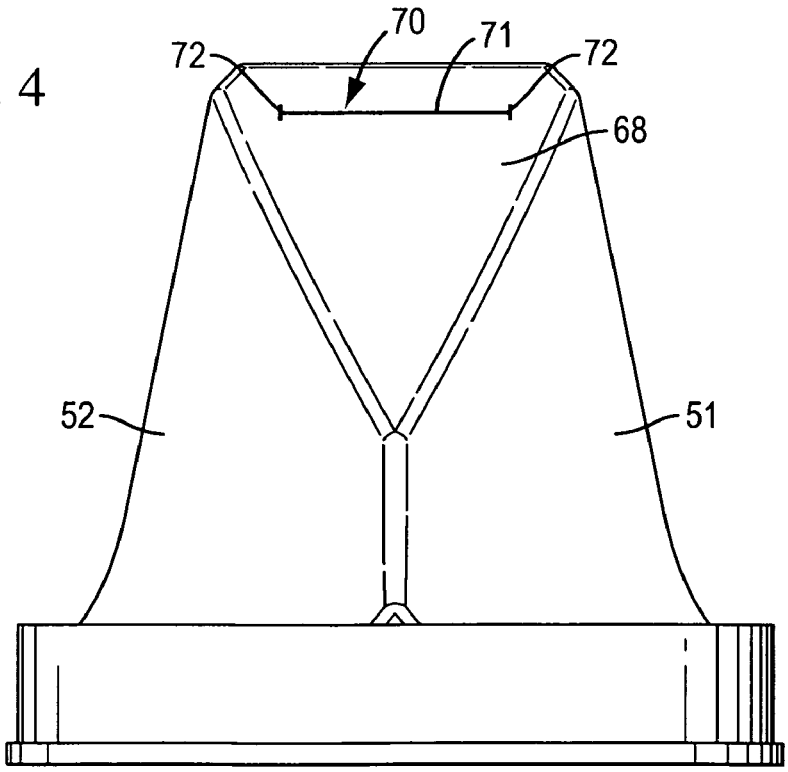
FIG. 4 is a front, elevational view of the valve.
Figure 7:
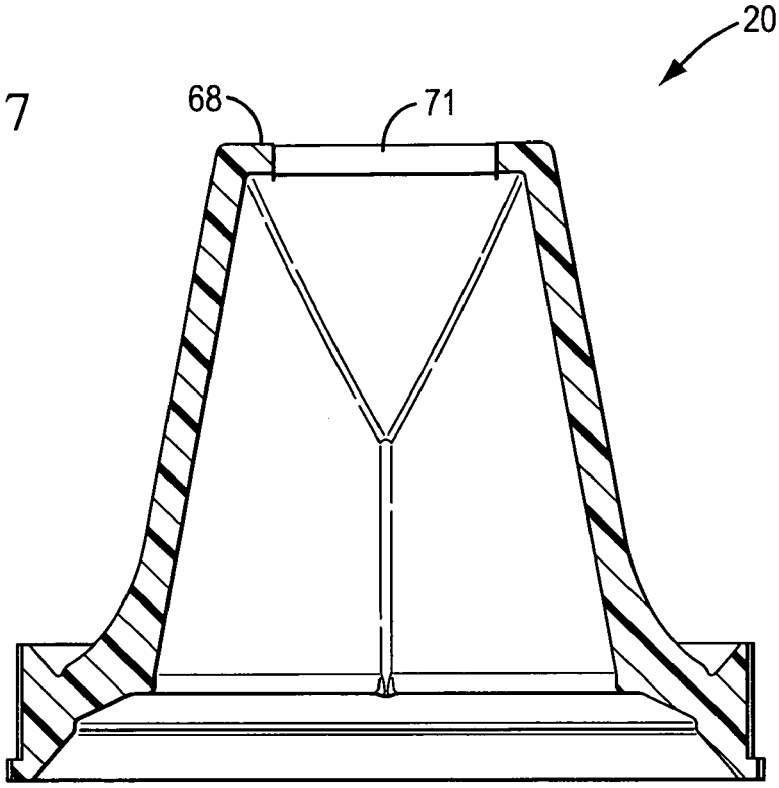
FIG. 7 is a cross-sectional view taken generally along the plane 7-7 in FIG. 5.
Figure 8:
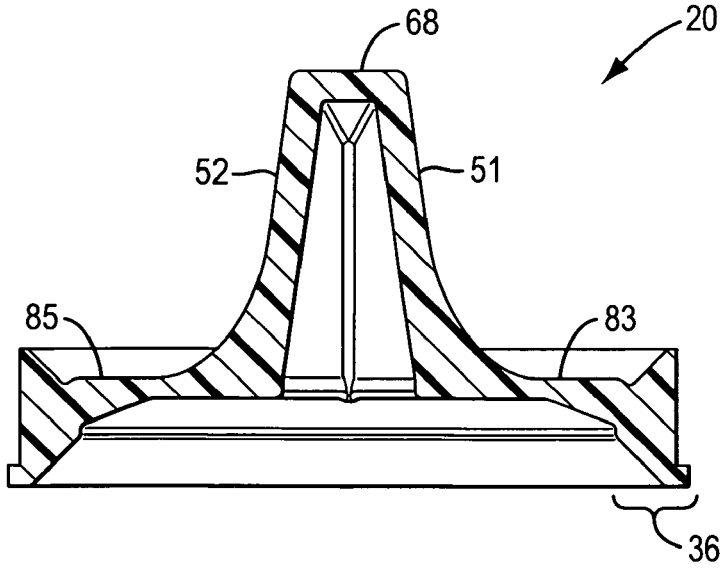
FIG. 8 is a cross-sectional view taken generally along the plane 8-8 in FIG. 5.
Figure 9:
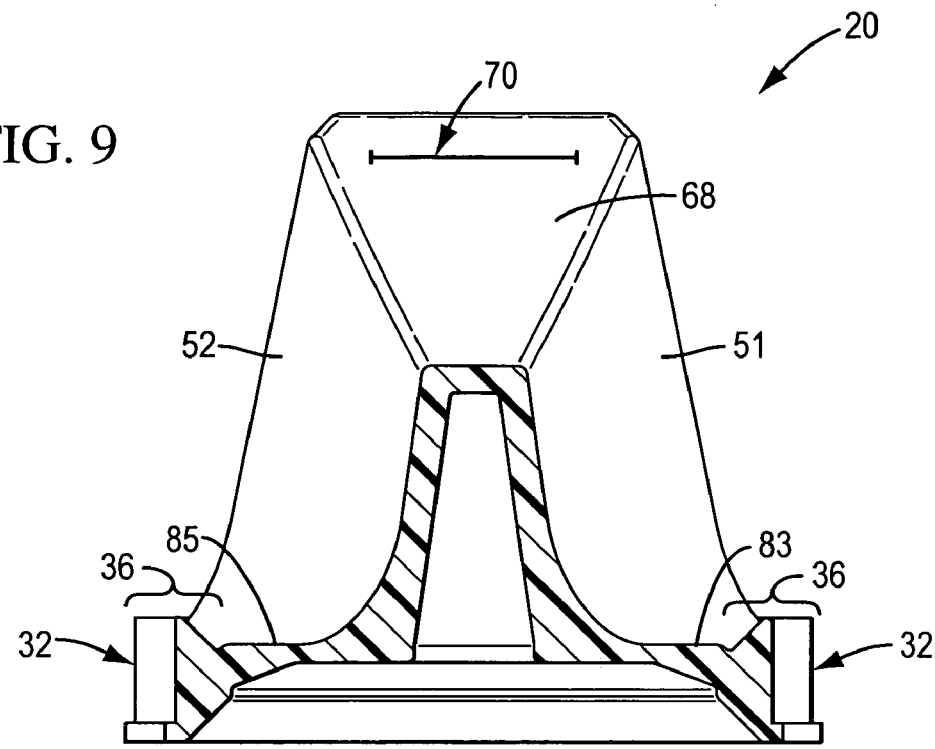
FIG. 9 is a cross-sectional view taken generally along the plane 9-9 in FIG. 5.
Figure 10:
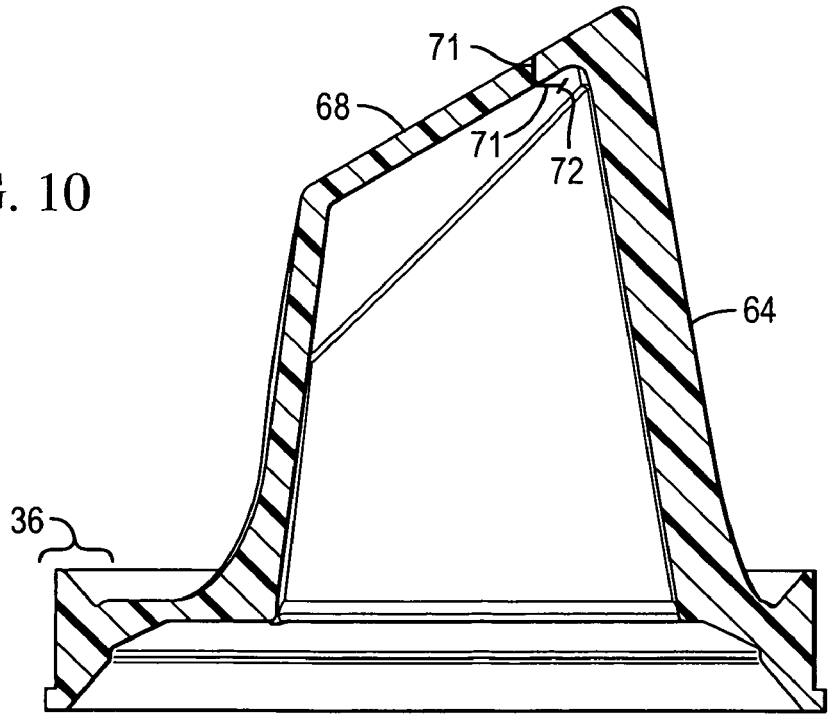
FIG. 10 is a cross-sectional view taken generally along the plane 10-10 in FIG. 5.

FIGS. 1-12 illustrate a first embodiment of the dispensing valve of the present invention which is designated generally by reference number 20 in FIGS. 1 and 2. In the preferred embodiment illustrated, the dispensing valve 20 is adapted to be mounted in a separate closure (not illustrated) which can be formed as part of, or separately mounted on, a container (not illustrated) that would typically contain a fluent substance. Examples of various types of a container and closure system which can be adapted to incorporate the dispensing valve 20 are disclosed in FIGS. 14-17 and FIGS. 26-27 of U.S. Pat. No. 5,033,655 and FIGS. 1-14 of U.S. Pat. No. 7,086,572. The detailed design of such closures and containers forms no part of the present invention.

The illustrated, preferred form of the valve 20 is adapted to be used with a container having an opening to provide access to the container interior and to a product contained therein. The valve 20 can be used to dispense many substances, including, but not limited to, relatively low or high viscosity liquids, creams, gels, suspensions, mixtures, lotions, etc. (such as a material constituting a food product, a beverage product, a personal care product, an industrial or household cleaning product, or other compositions of matter (e.g., compositions for use in activities involving manufacturing, commercial or household maintenance, construction, agriculture, medical treatment, military operations, etc.)).

The container with which the valve 20 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to either pressurize the container interior at selected times with a piston or other pressurizing system, or to instead reduce the exterior ambient pressure so as to cause the valve to open and to cause the product to be sucked out through the open valve.

As can be seen in FIGS. 1 and 2, the particular illustrated valve 20 includes two basic portions, (1) a dispensing head 30, and (2) a mounting base 32. The valve 20 is preferably molded as a unitary structure from material which is preferably flexible, pliable, elastic, and resilient. This can include elastomers, such as a synthetic, thermosetting polymer, including silicone rubber, such as the silicone rubber sold by Dow Corning Corp. in the United States of America under the trade designation D.C. 99-595-HC. Another suitable silicone rubber material is sold in the United States of America under the designation Wacker 3003-40 by Wacker Silicone Company. Both of these materials have a hardness rating of 40 Shore A. The valve 20 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

With reference to FIG. 6, in the illustrated preferred embodiment, the base 32 includes a portion 36 having a peripheral annular ring configuration for being clamped between suitable mating elements or surfaces of a closure (not illustrated) or between a surface or surfaces of a container (not illustrated) on the bottom and a closure on the top.

In the preferred embodiment of the valve base 32 as shown in FIG. 6, the peripheral annular configuration portion 36 is defined in part by a generally upwardly facing frustoconical surface 41 and a generally downwardly facing frustoconical surface 43. These two surfaces define what may be characterized in the cross-sectional view of FIG. 6 as a dove-tail configuration. The surfaces 41 and 43 are intended to confront, and matingly engage, corresponding clamping or seating surfaces of elements of a closure (not illustrated) or closure and container (not illustrated) so as to securely clamp and hold the valve 20 in place at the distal end of a container containing a fluent substance to be dispensed through the valve 20.

In other contemplated embodiments, the valve 20 need not have a peripheral, annular ring configuration portion 36 at all, or the portion 36 could have some other configuration than that illustrated in FIG. 6. Indeed, in one contemplated embodiment, the valve 20 could have a base that could be bonded by adhesive or bi-injection molding to a mounting component (e.g., the top of a container or a portion of a closure to be mounted on a container). Further, in another contemplated embodiment, the valve could be a unitary extension of a container molded from the same material as the valve. In such an embodiment, the top of the container might be considered to be the valve base or part of the valve base.

As can be seen in the preferred embodiment illustrated in FIG. 1, the valve head 30 includes a number of peripheral walls which each projects outwardly from the base 32, and in the preferred embodiment illustrated, there are five such peripheral walls: (1) a first forward side wall 51 (FIGS. 1, 4, and 5), (2) a second forward side wall 52 (FIGS. 1, 4, and 5), (3) a first rearward side wall 61 (FIGS. 1, 2, and 5), (4) a second rearward side wall 62 (FIGS. 1 and 5), and (5) a back wall 64 (FIGS. 5 and 6) which is between, and joins, the rearward side walls 61 and 62 as can be seen in FIG. 5.

According to the present invention, there are at least three peripheral walls that project outwardly from the base 32, and in the preferred embodiment illustrated in FIGS. 1-12, there are five such peripheral walls, namely, walls 51, 52, 61, 62, and 64.

As can be seen in FIG. 1, the dispensing head 30 also includes an end wall 68. The end wall 68 defines a dispensing orifice 70, which in the preferred embodiment illustrated in FIGS. 1-12, is a normally closed dispensing orifice. In particular, with reference to FIG. 4, the normally closed dispensing orifice 70 is defined by a generally elongate slit 71 terminating on each end at a very short transverse slit 72 which is generally perpendicular to the elongate slit 71. The resulting configuration may be also characterized as a very squat and wide H-shaped configuration.

The end wall 68 defines a spreading surface around the orifice 70 for use in spreading, smoothing, wiping, or scraping the dispensed product. The end wall 68 extends between, and connects, the outer margins of the peripheral walls 51, 52, 61, 62, and 64. The end wall 68 is oriented to present its spreading surface extending from a first location to a second location that is further outwardly from the base 32 than is the first location. That is, with reference to the particular preferred, first embodiment illustrated in FIGS. 1-12, the exterior spreading surface of the end wall 68 is generally planar (as can be seen in FIG. 6) and extends at an angle from a first location designated by the letter A in FIG. 6 to a second location designated by the letter B in FIG. 6. With reference to FIG. 6, it is clear that the first location A is lower than the second location B, and that the second location B is further outwardly from the base 32 than the first location A.

As can be seen in the plan view of FIG. 5, the end wall 68 may be characterized as having an exterior surface presenting a generally polygonal configuration defined by five sides. Also, as can be seen in FIGS. 5, 6, 7, 8, 9, and 10 for the one preferred embodiment illustrated therein, at least the upper portion of the peripheral walls 51, 52, 61, 62, and 64 may be characterized as each defining a generally planar exterior surface. Each of the peripheral walls 51, 52, 61, 62, and 64 extends downwardly to the closure base 32 as can be seen in FIG. 2. As the lower portions of the front side walls 51 and 52 approach the base 32, the walls 51 and 52 become slightly curved or flared outwardly.

The mounting base 32, which includes the peripheral annular ring configuration portion 36 as previously described, also includes portions which extend laterally inwardly from the annular ring configuration portion 36. Specifically, with reference to FIG. 5, there is a portion 81 extending from the annular ring configuration portion 36 to the bottom of the back wall 64. Also, with reference to FIG. 9, the valve base 32 includes a portion 83 extending laterally from the annular ring configuration portion 36 of the base 32 to the bottom of the forward side wall 51. Similarly, the valve base 32 includes a generally horizontal portion 85 extending laterally from the peripheral annular ring configuration portion 36 to the bottom of the other forward side wall 52.

The valve head 30 extends over an interior volume defined above the base 32. The valve head 30 preferably tapers or narrows over most of its height.

In the preferred embodiment, each valve head slit 71 and 72 has a planar configuration through the valve end wall 68, and each slit 71 and 72 is formed so that the opposing, transverse side faces the valve slits closely seal against one another when the dispensing orifice 70 is in its normal, fully closed position. The length and location of the slits 71 and 72 can be adjusted to vary the predetermined opening pressure of the valve 20, as well as other dispensing characteristics.

The valve 20 is especially suitable for dispensing thicker products, such as denture creams and thick lotions, and the like. The dimensions of the various portions of the dispensing valve 20 may be readily adapted for use in conjunction with a particular container and a specific type of product, so as to achieve the dispensing characteristics desired. For example, the viscosity and density of the fluid product can be factors in designing the specific dimensions of portions of the valve 20. The rigidity and durometer of the valve material, and specific size and shape of the valve head 30 also can be selected to accommodate the desired dispensing characteristics.

It is to be understood that, according to the present invention, portions of the valve 20 may be varied, particularly as may be necessary to accommodate the type of container and product to be dispensed therefrom. The predetermined opening pressure of the valve 20 may be varied in accordance with those dispensing criteria desired for a particular product. Flow characteristics of the dispensed product through the valve 20 can also be adjusted, such as for relatively a wide ribbon-like discharge, narrow discharge, multiple discharges, and the like.

The valve head 30 can be made sufficiently small in cross section so that the valve head 30 can fit in narrow regions or crevices. The valve 20 is especially suitable for directing a product into a confined area, such as in the underside of a denture. The valve 20 can be used to press and spread the product onto the desired surface or surfaces. The valve 20 can be made sufficiently flexible to help the valve to fit within constricted, narrow regions (i.e., putting the valve head 30 into a narrow region may require that some or all of the peripheral walls 51, 52, 61, 62, and 64 be temporarily deformed (e.g., flexed laterally inwardly)).

The spreading surface on the exterior of the end wall 68 can be used in spreading or placing the dispensed product in the desired locations with the desired lateral distribution, thickness, smoothness, etc.

Further, the upper, outermost projecting, side or edge along the top of the end wall 68 (i.e., the edge at location B in FIG. 6) can be used as a pivot edge to pivot the valve 20 as might be desired during application of the dispensed product. That edge may also be used to move or scrape product away from one area or into an area.

The smooth spreading surface on the end wall 68 of the valve 20 facilitates removal of excess dispensed product from the face of the valve after the dispensing activity has been completed. The surface of the end wall 68 can also be scraped against an edge of another surface, including the surface of a substrate onto which the product has been dispensed, so as to scrape or clear away much, if not all, of any residual product that may remain on the end wall 68.

The valve 20 can be provided in an appropriate size and made from a selected material with selected wall thicknesses that will accommodate dispensing of the product through the valve without requiring that an excessively high pressure differential be imposed across the valve end wall 68 to achieve the desired discharge flow.

The product can be dispensed through the valve 20 in a one-handed operation. The use of such a valve 20 can accommodate various users, including the elderly and/or people with arthritis who might otherwise have difficulty dispensing a product from other types of dispensing devices.

According to one presently contemplated form of the first embodiment of the valve 20 illustrated in FIGS. 1-12, the end wall 68 has a generally uniform thickness which is less than the thickness of any of the peripheral walls 51, 52, 61, 62, and 64. Further, in the preferred embodiment, each forward side wall 51 and 52 has a thickness that is less than the thickness of the back wall 64. The back wall thus provides a stiffer system and prevents the valve 20 from buckling or folding rearwardly or backward. In a presently contemplated preferred form of the first embodiment of valve 20, the forward side walls 51 and 52 each has a thickness of about one half the thickness of the rear wall 64. In the presently contemplated preferred form of the first embodiment of the valve 20 illustrated in FIGS. 1-12, the end wall 68 has a thickness that is about one third the thickness of the back wall 64 and also about one third the thickness of each of the two rearward side walls 61 and 62.

Further, in one presently contemplated preferred embodiment, the valve 20 has a maximum straight line distance across the planar exterior surface of the end wall 68 from any point along one edge of the end wall planar exterior surface to any other point along another edge of the end wall planar exterior surface that is greater than about 50% of the maximum straight line distance across the base 32 between any two points on the base 32 where the base 32 joins the back wall 64, the rearward side walls 61 and 62, and the forward side walls 51 and 52.

In one presently contemplated form of the first embodiment of the valve 20 illustrated in FIGS. 1-12, the valve base 32 is circular and has a diameter of about 13.92 millimeters, the maximum height of the base 32 along the exterior cylindrical surfaces is about 12.54 millimeters, and the maximum height of the valve 20 (from the bottom of the base 32 to the outermost projection of the valve head 30 (along the location B in FIG. 6)) is about 12.82 millimeters. In that one presently contemplated form of the first embodiment illustrated in FIGS. 1-12, the thickness of the back wall 64 is about 1.02 millimeters, and the exterior spreading surface of the end wall 68 defines a plane disposed generally at an angle of between about 40 degrees and about 50 degrees relative to the plane defined by the valve base peripheral annular ring configuration 36. Further, in that first preferred embodiment, the maximum width of the end wall 68 (in the direction parallel to the elongate aperture 71) is about 6.6 millimeters. Further, in the first preferred embodiment, the elongate aperture 71 has a length of about 4.09 millimeters, and each transverse end slit 72 has a length of 0.25 millimeter. The contemplated first preferred form of the valve 20 with the above-described dimensions is preferably molded from 40 durometer silicone.

Figure 11:
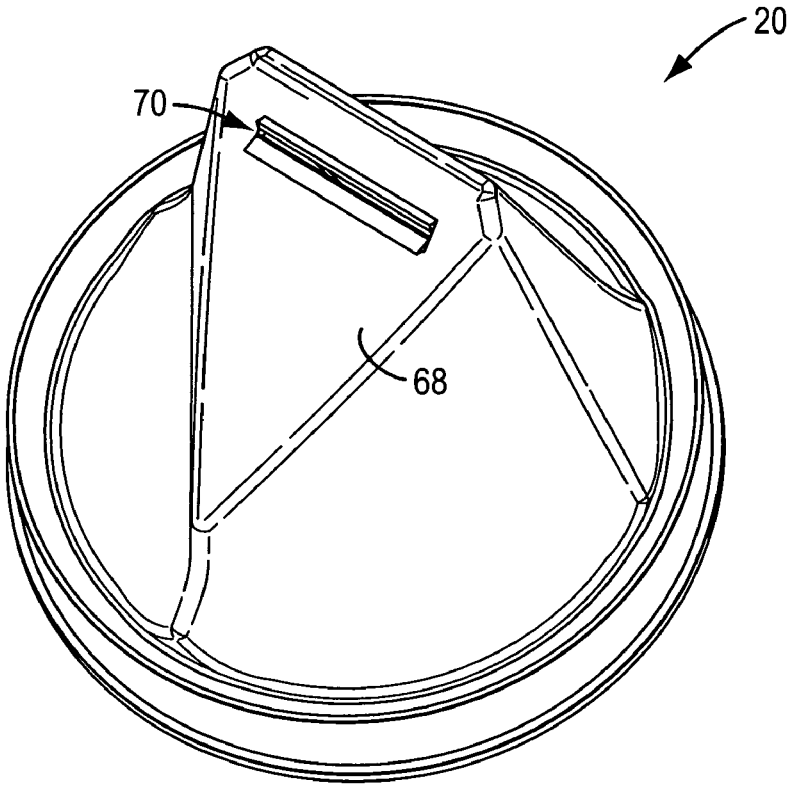
FIG. 11 is an isometric view similar to FIG. 1, but in FIG. 11, the valve is shown in an opened dispensing position wherein the dispensing orifice has been opened as a result of the application of a sufficiently great pressure differential across the valve.
Figure 12:
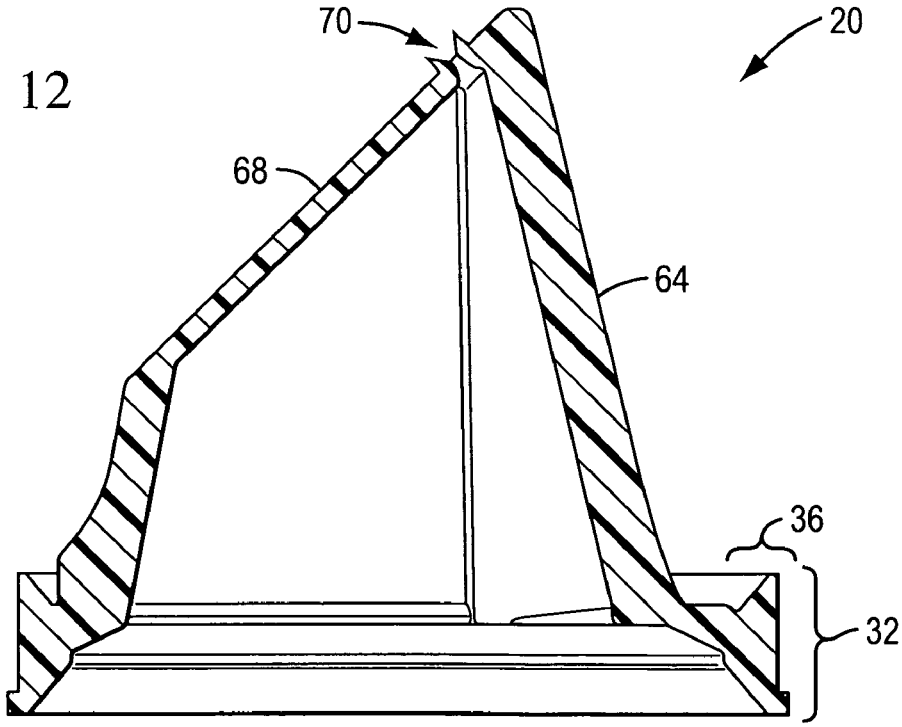
FIG. 12 is a cross-sectional view similar to FIG. 6, but in FIG. 12 the valve is shown with the dispensing orifice in the opened, dispensing configuration.

In the illustrated preferred form of the valve 20, the valve 20 normally remains in the closed configuration shown in FIGS. 1-10 unless it is subjected to opening forces. The valve 20 can be opened by applying a sufficiently large pressure differential across the valve head 30 when the valve 20 is in the closed configuration so that the pressure acting on the exterior of the valve head 30 is lower than the pressure acting on the interior of the valve head 30. Such a pressure differential acts outwardly on the portions of the valve end wall 68 adjacent the elongate slit 71 to open the valve as shown in FIGS. 11 and 12. The opening pressure differential can be achieved by pressurizing the interior of the container to which the valve 20 is mounted. Typically, the container would have a flexible wall which can be squeezed inwardly by the user to increase the pressure within the container. This can be done while holding and squeezing the container (with the valve 20 mounted thereon) in an inverted orientation so that the fluent substance or other product within the container is pressurized against the closed valve 20. As the pressure moves the valve to the open configuration, the product flows through the open slits.

The valve 20 could also be opened by applying a sufficiently reduced atmospheric pressure on the valve exterior so that the pressure on the valve head exterior is sufficiently below the internal pressure acting against the valve head interior surface to cause the valve to open outwardly (see FIGS. 11 and 12).

If the container on which the closed valve 20 is mounted inadvertently tips over, then the product will not flow out of the valve 20 because the valve 20 remains closed. Preferably, the valve 20 is designed to withstand the weight of the fluent substance product on the inside of the valve 20 when the container is completely inverted. Preferably, the valve 20 is designed to open only after a sufficient amount of pressure differential acts across the valve (e.g., as by the user squeezing the container with sufficient force (if the container is not a rigid container)).

When dispensing product through the preferred form of the valve 20 in the open condition, if the differential pressure across the valve 20 decreases sufficiently, then the inherent resiliency of the valve 20 will cause it to close. The valve 20 will then assume the closed position illustrated in FIGS. 1-10.

In one preferred embodiment, the valve 20 opens outwardly only when the valve head 30 is subjected to a predetermined pressure differential acting in a gradient direction wherein the pressure on the valve head interior surface exceeds—by a predetermined amount—the local ambient pressure on the valve head exterior surface. The product can then be dispensed through the open valve 20 until the pressure differential drops below a predetermined amount, and the valve 20 then closes completely.

In one optional form of the valve 20, the valve 20 can be designed to be flexible enough to accommodate in-venting of ambient atmosphere as described in detail below, then the closing portions of the end wall 68 adjacent the slit 71 can continue moving inwardly to allow the valve to open inwardly as the pressure differential gradient direction reverses and the pressure on the valve head exterior surface exceeds the pressure on the valve head interior surface by a predetermined amount.

For some dispensing applications, it may be desirable for the valve 20 not only to dispense the product, but also to accommodate such in-venting of the ambient atmosphere (e.g., so as to allow a squeezed container (on which the valve is mounted) to readily return to its original shape). Such an in-venting capability can be provided by selecting an appropriate material for the valve construction, and by selecting appropriate thicknesses, shapes, and dimensions for various portions of the valve head 30 for the particular valve material and overall valve size. The shape, flexibility, and resilience of the valve head 30 can be designed or established so that the valve head end wall 68 will deflect inwardly at the slit 70 when subjected to a sufficient pressure differential that acts across the head 30 and in a gradient direction that is the reverse or opposite from the pressure differential gradient direction during product dispensing. Such a reverse pressure differential can be established when a user releases a squeezed, resilient container on which the valve 20 is mounted. The resiliency of the container wall (or walls) will cause the wall to return toward the normal, larger volume configuration. The volume increase of the container interior will cause a temporary drop in the interior pressure. When the interior pressure drops sufficiently below the exterior ambient pressure, the pressure differential across the valve 20 will be large enough to deflect the valve head and wall 68 inwardly to permit in-venting of the ambient atmosphere. In some cases, however, the desired rate or amount of in-venting may not occur until the squeezed container is returned to a substantially upright orientation that allows the product to flow under the influence of gravity away from the valve head 30.

The illustrated preferred embodiment of the valve 20 provides an improved dispensing valve with the capability for allowing the user to readily view, target, and control the dispensing of the fluent material from the valve 20. The valve 20 can function to dispense a product accurately while minimizing the likelihood of accidental, premature, or undesired product discharge, and while providing good product cut-off at the termination of dispensing with little or no mess of product left on the exterior of the valve (or package containing the valve). The closed valve can minimize, or at least reduce, the likelihood either of the product drying out in the package or being contaminated.

Figure 13:
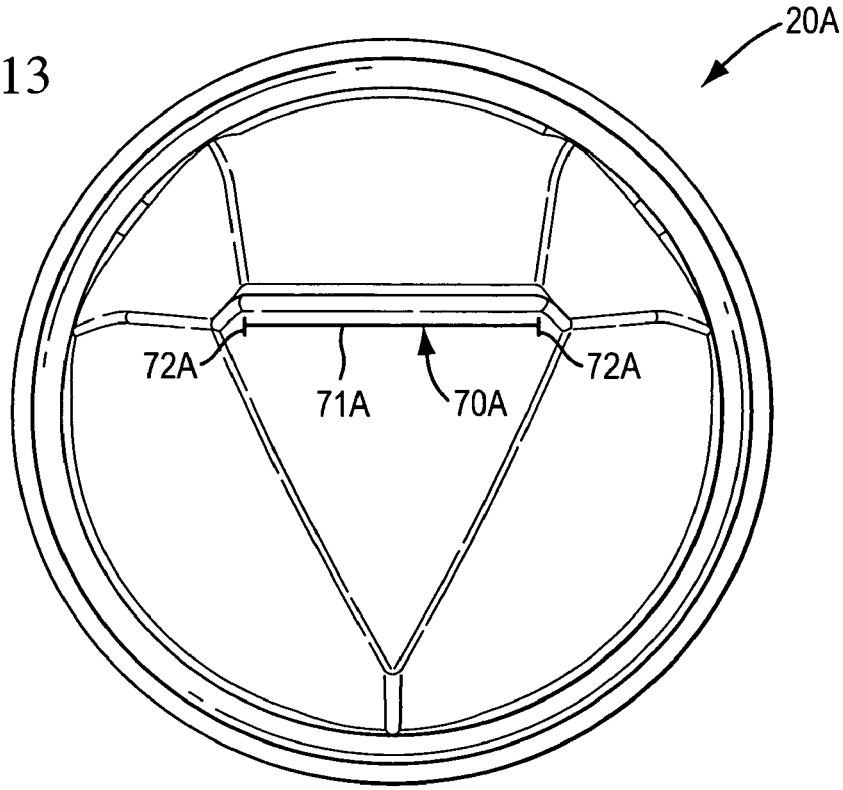
FIG. 13 is a top, plan view of a second embodiment of the valve of the present invention.
Figure 14:
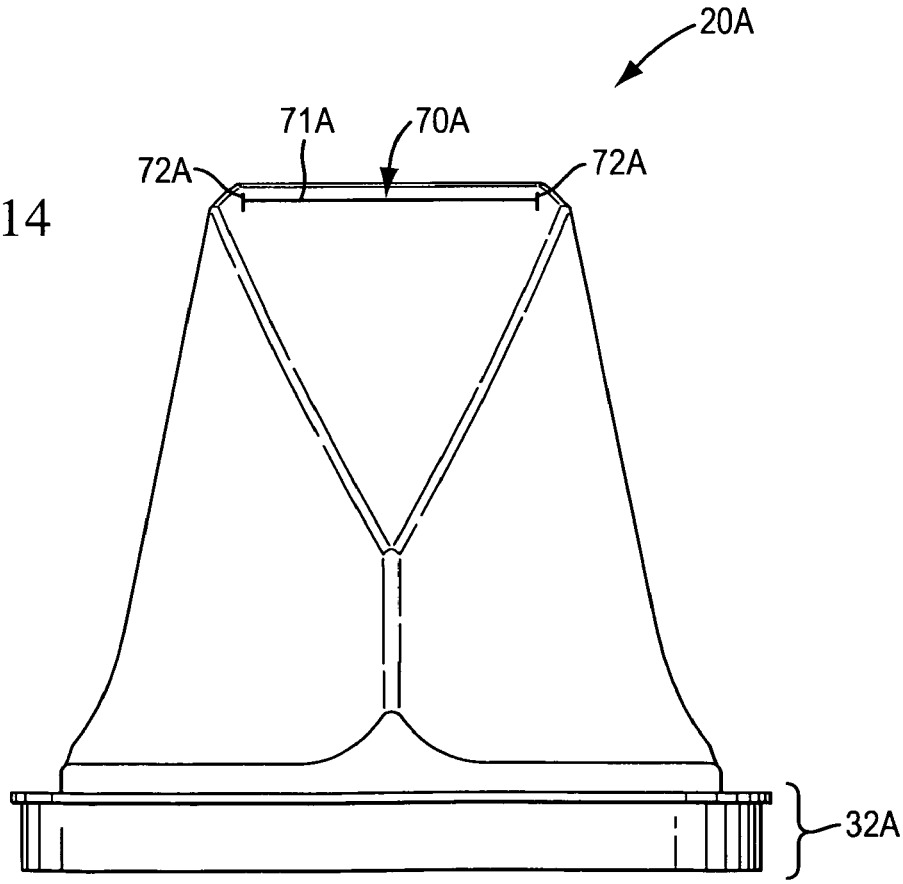
FIG. 14 is a front elevational view of the second embodiment of the valve shown in FIG. 13.

FIGS. 13 and 14 illustrate a second embodiment of the valve of the present invention wherein the second embodiment valve is designated generally by the number 20A. The second embodiment of the valve 20A has a base 32A (FIG. 14) and is similar to the first embodiment of the valve 20 described above with reference to FIGS. 1-12. However, the second embodiment valve 20A has a dispensing orifice 70A, comprising an elongate slit 71A and two, transverse end slits 72A, located outwardly or upwardly a small amount closer to the top edge of the valve compared to the location of the corresponding dispensing orifice 70 in the first embodiment valve 20.

Figure 15:
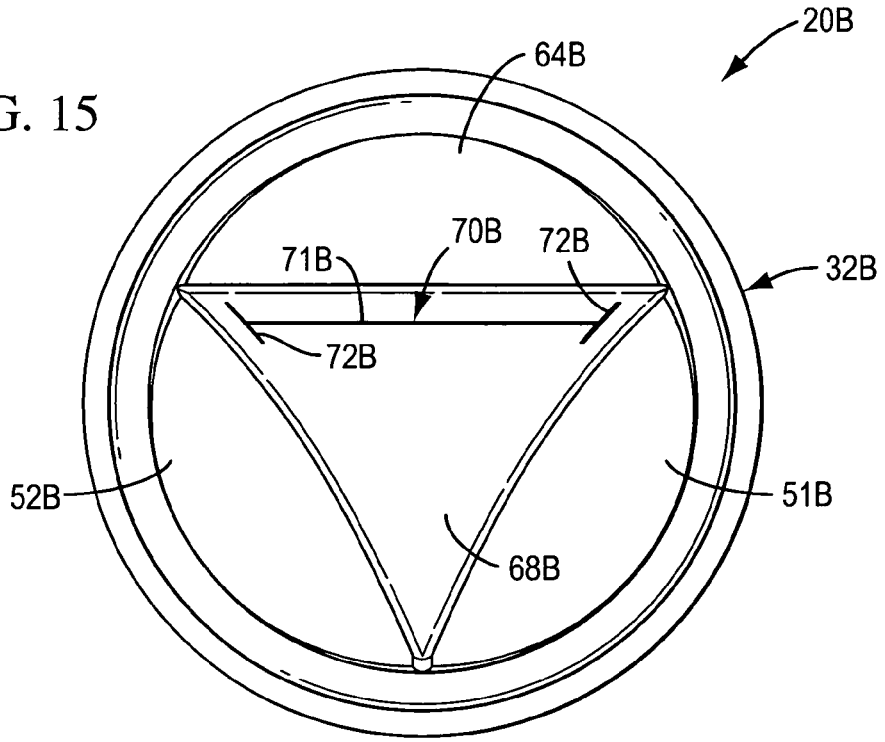
FIG. 15 is a top, plan view of a third embodiment of the valve of the present invention.
Figure 16:
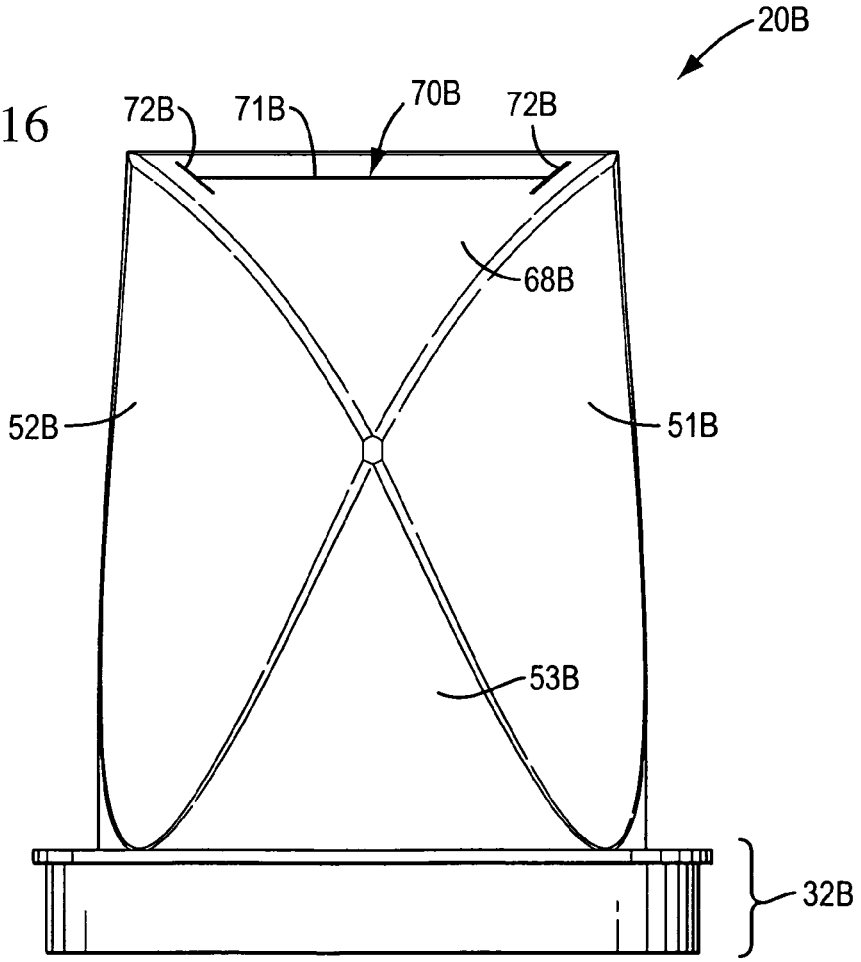
FIG. 16 is a front, elevational view of the third embodiment of the valve shown in FIG. 15.

FIGS. 15 and 16 illustrate a third embodiment of the valve wherein the third embodiment is designated generally by the reference number 20B. The third embodiment valve 20B has a mounting base 32B with four outwardly projecting peripheral walls: a back wall 64B, two forward side walls 51B and 52B, and a lower front wall 53B.

The forward side wall 51B, forward side wall 52B, and back wall 64B taper inwardly with increasing height or distance away from the base 32B, and the outer margins or top edges of the walls 51B, 62B, and 64B define the sides of an end wall 68B which extends between the top edges or outer margins of the forward side wall 51B, forward side wall 52B, and back wall 64B.

The end wall 68B defines a normally closed dispensing orifice 70B comprising an elongate slit 71B terminating at each end in a short slit 72B. Each short slit 72B is at an oblique angle relative to the length of the elongate slit 71B.

Figure 17:
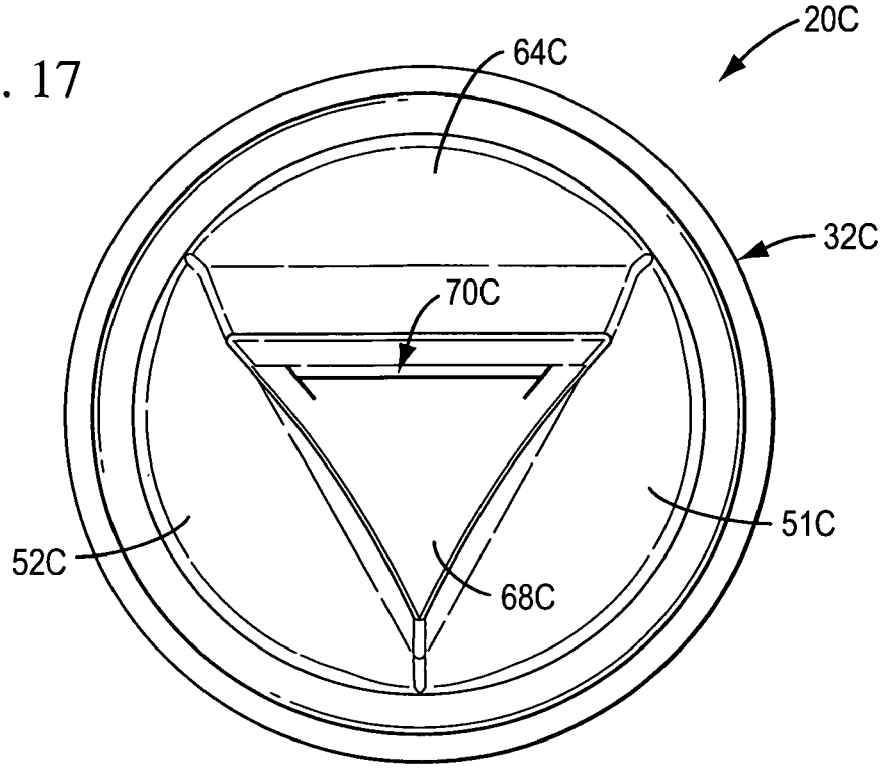
FIG. 17 is a top, plan view of a fourth embodiment of the valve of the present invention.
Figure 18:
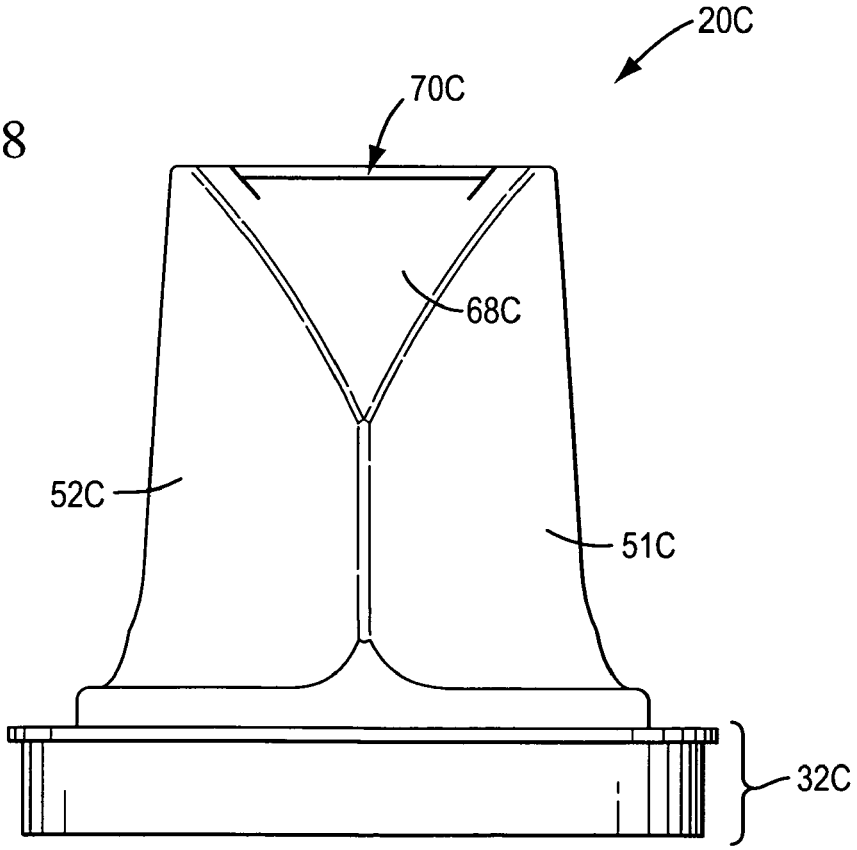
FIG. 18 is a front, elevational view of the fourth embodiment of the valve shown in FIG. 17.

FIGS. 17 and 18 illustrate a fourth embodiment of a valve of the present invention wherein the fourth embodiment invention is designated generally by the reference number 20C. The fourth embodiment valve 20C is similar to the third embodiment valve 20B described above with reference to FIGS. 15 and 16, except that the fourth embodiment valve 20C has forward side walls 51C and 52C which are more extensive than the corresponding third embodiment forward side walls 51B and 52B, respectively, because the fourth embodiment valve forward side walls 51C and 52C extend all the way down to the valve base 32C at the front of the valve 20C so as to eliminate the front wall 53B found in the third embodiment valve illustrated in FIGS. 15 and 16.

The fourth embodiment valve 20C, illustrated in FIGS. 17 and 18 also includes a back wall 64C and an end wall 68C having a dispensing aperture 70C substantially identical with the dispensing aperture 70B in the third embodiment valve 20B discussed above with reference to FIGS. 15 and 16.

Figure 19:
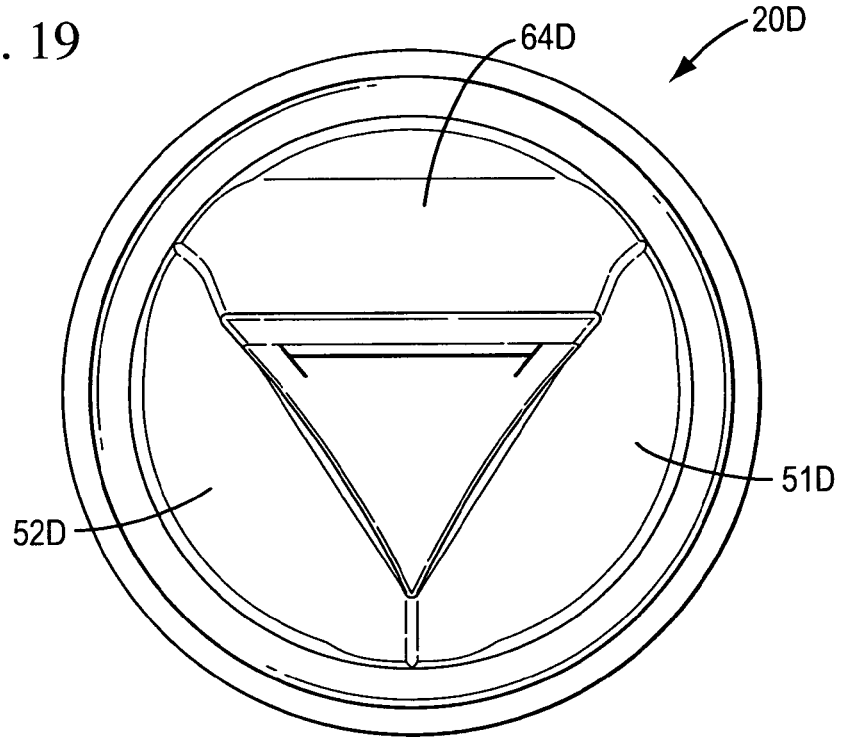
FIG. 19 is a top, plan view of a fifth embodiment of the valve of the present invention.
Figure 20:
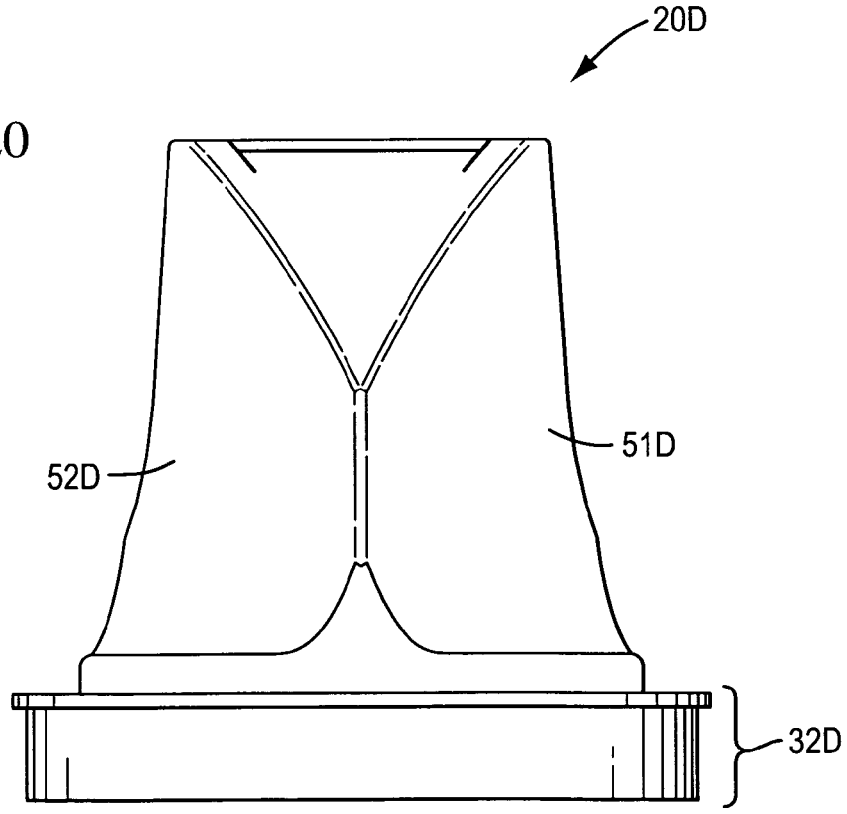
FIG. 20 is a front elevational view of the fifth embodiment of the valve shown in FIG. 19.

FIGS. 19 and 20 illustrate a fifth embodiment of the valve of the present invention designated generally by the reference number 20D. The valve 20D has a back wall 64DF and two side walls 51D and 52D. The fifth embodiment valve 20D is similar to the fourth embodiment valve 20C described above with reference to FIGS. 17 and 18, except that the fifth embodiment valve forward side wall 51D and a forward side wall 52D each has a lower margin adjacent the front of the valve base 32D which has a slightly different configuration compared to the corresponding walls 51C and 52C in the fourth embodiment valve 20C.

Figure 21:
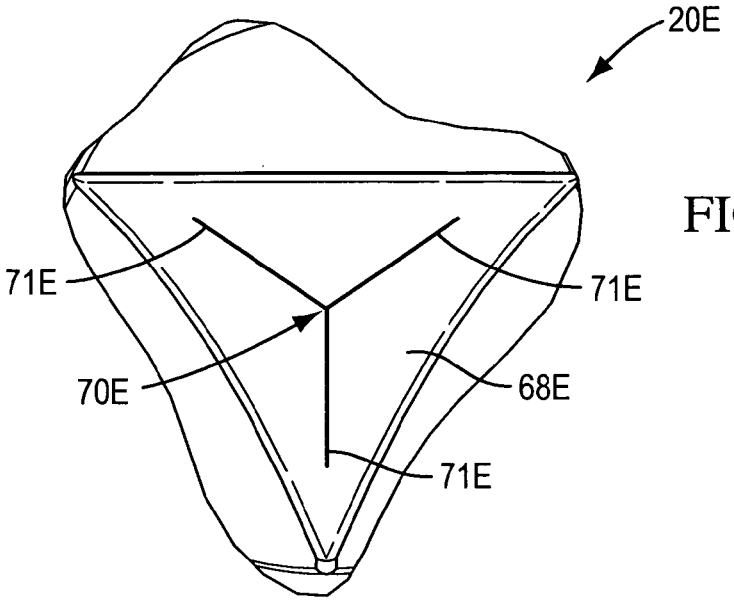
FIG. 21 is a fragmentary, top, plan view of a portion of a valve head of a sixth embodiment of the valve of the present invention.
Figure 22:
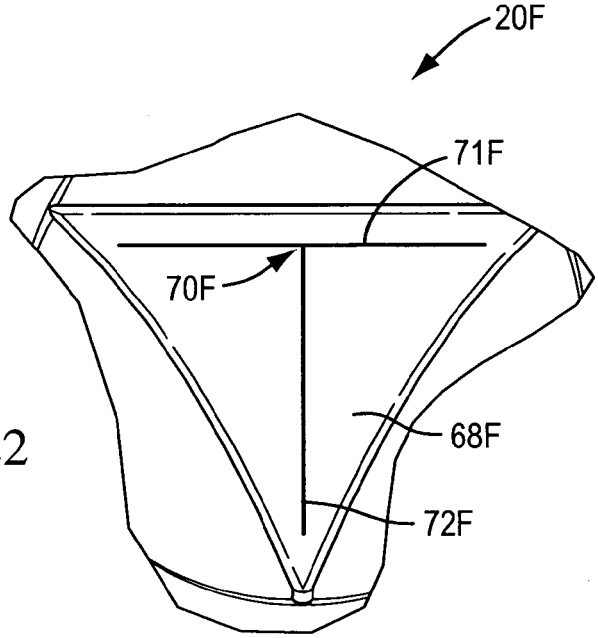
FIG. 22 is a fragmentary, top, plan view of the valve head of a seventh embodiment of the valve of the present invention.
Figure 23:
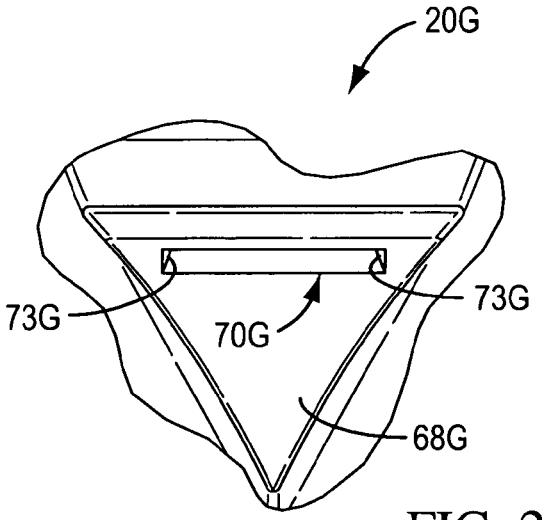
FIG. 23 is a fragmentary, top, plan view of the valve head of an eighth embodiment of the valve of the present invention.

FIGS. 21, 22, and 23 illustrate fragmentary portions of the top, outermost projecting portion of three modifications of the third embodiment valve 20B discussed above with reference to FIGS. 15 and 16. FIG. 21 shows a modified embodiment 20E in which the end wall 68E has a dispensing orifice 70E defined by three slits 71E which each extends outwardly from a common vertex to define equal angles between them. FIG. 22 shows a modified embodiment 20F which has an end wall 68F having a dispensing orifice 70F defined by a horizontal, elongate slit 71F and an elongate, vertically oriented slit 72F. The slits 71F and 72F together define a generally T-shaped configuration. FIG. 23 shows a modified valve 20G with an end wall 68G defining a normally slightly open dispensing orifice or aperture 70G. The dispensing aperture 70G is defined by a narrow slit or groove extending completely through the valve end wall 68G. FIG. 23 shows the dispensing orifice slit 70G terminating at each end in a transverse end wall 73G defined by the thickness of the end wall 68G. The normally open dispensing orifice 70G can be used in a valve intended for dispensing a relatively thick or viscous substance and/or a substance having a relatively high surface tension. If a package employing such a valve 20G with such a narrow, open, dispensing orifice 70G is inverted, the thick product inside the valve would not normally leak out through the orifice 70G unless a sufficient pressure differential was applied across the valve (as by squeezing a container to which the valve is attached and which contains the product to be dispensed). In some applications, it may be desirable to provide an auxiliary cover or lid for covering the valve 20G and top of the container to which the valve 20G is mounted. The user would remove such a cover or lid in order to dispense the product through the valve 20G.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing valve comprising:

(A) a mounting base; and (B) flexible, resilient material defining a dispensing head extending outwardly from said base, said dispensing head including (1) at least three peripheral walls that each projects outwardly from said base and that each defines an outer margin; and (2) an end wall that (a) defines a dispensing orifice;

(b) defines a spreading surface around said orifice;

(c) extends between, and connects, said outer margins of said peripheral walls; and (d) is oriented to present said spreading surface extending from a first location to a second location that is further outwardly from said base than is said first location; and wherein said dispensing head peripheral walls include (1) two converging forward side walls;

(2) two rearward side walls each extending rearwardly from one of said forward side walls and toward each other; and (3) a back wall between, and joining, said rearward side walls; and wherein each said forward side wall, each said rearward side wall, and said back wall have at least a portion defining a generally planar exterior surface; and said end wall spreading surface is an exterior surface presenting a generally polygonal configuration defined by five sides.

2. The dispensing valve in accordance with claim 1 in which each said forward side wall has a thickness less than the thickness of said back wall.

3. The dispensing valve in accordance with claim 1 in which said end wall has a thickness that is about one third the thickness of said back wall.

4. The dispensing valve in accordance with claim 1 in which the thickness of said back wall is 1.02mm.

5. The dispensing valve in accordance with claim 1 in which said back wall projects outwardly from where it joins said base to a location that is further outwardly than the furthest outwardly location of either of said forward side walls.

6. The dispensing valve in accordance with claim 1 in which said mounting base includes at least (1) a portion extending rearwardly from the bottom of said back wall;

(2) a portion extending laterally from the bottom of one of said forward side walls;

(3) a portion extending laterally from the bottom of the other of said forward side walls; and (4) a portion having a peripheral annular ring configuration; and said end wall has a generally planar exterior surface disposed at an angle of between about 40degrees and about 50degrees relative to a plane defined by said peripheral annular ring configuration.

7. The dispensing valve in accordance with claim 1 in which said dispensing orifice is a normally open, elongate aperture.

8. The dispensing valve in accordance with claim 1 in which said dispensing orifice is defined by at least one slit that is normally closed and that opens to permit flow therethrough in response to a pressure differential across said valve.

9. The dispensing valve in accordance with claim 1 in which said end wall has a generally uniform thickness which is less than the thickness of any of said peripheral walls.

10. The dispensing valve in accordance with claim 1 in which said end wall spreading surface is a generally planar exterior surface.

11. The dispensing valve in accordance with claim 1 in which said dispensing orifice is defined by three planar slits which define an H-shaped configuration and which are normally closed.

12. The dispensing valve in accordance with claim 1 in which said flexible, resilient material is silicone.

13. A dispensing valve comprising:

(A) a mounting base; and (B) flexible, resilient material defining a dispensing head extending outwardly from said base, said dispensing head including (1) at least three peripheral walls that each projects outwardly from said base and that each defines an outer margin; and (2) an end wall that (a) defines a dispensing orifice;

(b) defines a spreading surface around said orifice;

(c) extends between, and connects, said outer margins of said peripheral walls: and (d) is oriented to present said spreading surface extending from a first location to a second location that is further outwardly from said base than is said first location; and wherein said flexible resilient material is silicone;

said dispensing head extends over an interior volume that (1) is defined above said base, and (2) extends laterally beyond said dispensing orifice;

said end wall has a generally planar exterior surface; and the maximum straight line distance across said end wall planar exterior surface from one edge of said end wall planar exterior surface to another edge of said end wall planar exterior surface is greater than about 50% of the maximum straight line distance between any two points on said base where said base joins said peripheral walls.

14. A dispensing valve comprising:

(A) a mounting base; and (B) flexible, resilient material defining a dispensing head extending outwardly from said base, said dispensing head including (1) two converging forward side walls;

(2) two rearward side walls each extending rearwardly from one of said forward side walls and toward each other;

(3) a back wall between, and joining, said rearward side walls; and (4) an end wall that (a) defines a dispensing orifice;

(b) defines a spreading surface around said orifice;

(c) extends between, and connects, said two forward side walls, two rearward side walls; and back wall; and (d) is oriented to present said spreading surface forwardly of said back wall.

15. The dispensing valve in accordance with claim 14 in which said dispensing orifice is defined by at least one slit;

each said forward side wall, each said rearward side wall, and said back wall have at least a portion defining a generally planar exterior surface adjacent said end wall; and said end wall spreading surface is an exterior surface presenting a generally polygonal configuration defined by five sides.

16. The dispensing valve in accordance with claim 14 in which said end wall has a generally uniform thickness which is less than the thickness of any of said forward side walls, rearward side walls, and back wall;

each said forward side wall has a thickness that is less than the thickness of said back wall;

said end wall has a thickness that is about one third the thickness of said back wall; and said back wall projects outwardly from where it joins said base to a location that is further outwardly than the furthest outwardly location of either of said forward side walls.

17. The dispensing valve in accordance with claim 14 in which said mounting base includes at least (1) a portion extending rearwardly from the bottom of said back wall;

(2) a portion extending laterally from the bottom of one of said forward side walls;

(3) a portion extending laterally from the bottom of the other of said forward side walls; and (4) a portion having a peripheral annular ring configuration; and said end wall has a generally planar exterior surface disposed at an angle of between about 40degrees and about 50degrees relative to a plane defined by said peripheral annular ring configuration.

18. The dispensing valve in accordance with claim 14 in which said end wall spreading surface is a generally planar exterior surface; and the maximum straight line distance across said end wall planar exterior surface from one edge of said end wall planar exterior surface to another edge of said end wall planar exterior surface is greater than about 50% of the maximum straight line distance between any two points on said base where said base joins said back wall, said forward side walls, and said rearward side walls.

19. The dispensing valve in accordance with claim 14 in which said dispensing orifice is defined by at least one slit that is a normally closed and that opens to permit flow therethrough in response to a pressure differential across said valve.

* * * * *